US005806568A

United States Patent [19]

Dewispelaere et al.

[11] Patent Number: 5,806,568

[45] Date of Patent: Sep. 15, 1998

[54] POSITIONING PILE YARNS IN A GRIPPER AXMINSTER CARPET WEAVING MACHINE

[75] Inventors: André Dewispelaere, Marke; Hans Desmet, Koolskamp, both of Belgium

[73] Assignee: N.V. Michel van de Wiele, Marke, Belgium

[21] Appl. No.: 775,601

[22] Filed: Dec. 31, 1996

[30] Foreign Application Priority Data

Jan. 16, 1996 [BE] Belgium ..... 09600034

[51] Int. Cl.[6] ..... D03D 39/08; D03D 51/18

[52] U.S. Cl. ..... 139/2; 139/7 R

[58] Field of Search ..... 139/2, 7 R

[56] References Cited

U.S. PATENT DOCUMENTS 3,400,738 9/1968 Fleischer et al. ..... 139/2

FOREIGN PATENT DOCUMENTS 1075082 7/1967 United Kingdom .
1150822 5/1969 United Kingdom .
1 357 528 6/1974 United Kingdom ..... 139/7
1405403 9/1975 United Kingdom .
1 573 726 8/1980 United Kingdom ..... 139/2
2 189 513 10/1987 United Kingdom ..... 139/2
2 189 515 10/1987 United Kingdom ..... 139/2
2190107 11/1987 United Kingdom .
2286601 8/1995 United Kingdom .
WO8911558 11/1989 WIPO .

*Primary Examiner*—Andy Falik
*Attorney, Agent, or Firm*—Sughrue, Mion, Zinn, Macpeak & Seas, PLLC

[57] ABSTRACT

For positioning pile yarns in variable selection positions in a carpet weaving machine of the gripper Axminster type, in which pile yarns (1–8) of different colors are placed next to each other in a line in pile yarn loaders (10), each pile yarn loader (10) is brought directly from a selection position to a following selection position. The selection movement thereby remains limited to moving over the distance between two successive selection positions.

5 Claims, 2 Drawing Sheets

POSITIONING PILE YARNS IN A GRIPPER AXMINSTER CARPET WEAVING MACHINE

BACKGROUND OF THE INVENTION

1. Field of the invention

This invention relates to a method and a device for positioning pile yarns in variable selection positions in a carpet weaving machine of the gripper Axminster type, in which pile yarns of different colors are placed next to each other in line in pile yarn loaders, which are moved by shifting according to the pattern in a longitudinal direction controlled by an electronic jacquard device, in order to bring the selected color opposite the gripper jaws.

In such carpet weaving machines the pile yarns are held in pile yarn loaders which protrude in a horizontal, oblique or vertical direction. The pile yarn ends protrude sufficiently on one side of the pile yarn loaders in order to be taken along by the gripper jaws. The gripper jaws are disposed rotatably in order to grip the protruding yarn ends in an upward turning movement and in order to bring these down, so that they can be woven into the ground fabric of the carpet.

The pile yarn loaders were disposed vertically in the past, so that the pile yarn was presented in a horizontal plane. With this disposition the grippers had to turn through a wide angle: in practice this amounted to approximately 155°. With more recent weaving machines of the gripper Axminster type more and more inclined dispositions of the yarn loader are found. Such a weaving machine is for example described in U.S. Pat. No. 3,963,058 and in GB-A-2 190 107.

2. Description of the prior art

Fully horizontally disposed pile yarn loaders are also known from GB-A-1 075 082 and GB-A-1 150 822. With these weaving machines the pile yarns extend in an almost vertical direction and in order that the grippers would be able to take the pile yarn with the selected color according to the pattern, individual yarns with different colors are placed next to each other in the same loader. This loader is then moved in a horizontal direction under the control of a jacquard device, so that the selected color is brought to the pick line of the gripper jaws.

Because of the fact that the grippers with these machines with horizontal pile yarn loaders have to rotate over a considerably smaller angle, these machines therefore have a potentially higher operating speed.

Each pile yarn then extends, from this feeder plane upward, to a distribution grid and from here it extends over suitable guiding means to a rack, in which the pile yarn supply for each color is placed.

The selected color according to the pattern to be woven is thus obtained by a shifting of the pile yarn loaders performed by a jacquard device, in a common horizontal plane, until the pile yarn with the selected color comes to lie just above the pick line of the grippers. From GB-A-1 075 082 and GB-A-1 150 822 such jacquard devices with a punched card as data a carrier are known. These devices have a card switching device and an impression device that presses a pin corresponding to the color to be selected from the pile yarn loaders. Through a sliding mechanism the pins are brought into line through which the pile yarn loaders are going to slide and therefore the selected color is brought to the line of the gripper jaws.

Electronic jacquard devices were developed in order to eliminate the costly operation of producing the punched cards as data carriers and in order to be able to make up a new pattern faster. Such devices are known from:

GB-A-2 190 107 for a pile yarn loader inclined in relation to a vertical device;

EP-A-0 420 869 for a vertical pile yarn loader, and

GB-A-2 286 601 for a horizontal pile yarn loader.

All these publications describe a jacquard device of the reset type, i.e. that prior to selection, all pile yarn loaders must first be brought back to a common reference position. From this reference position a cutting beam is moved and during this movement a pin or a catch is electronically operated when this is right in front of a tooth or another coupling device, which corresponds to the color to be selected. During this movement the pile yarn loader is coupled to the moving cutting beam. At the end of the movement of the cutting beam the selected color is in line with the grippers. After pulling and cutting off the selected pile yarns all pile yarns are brought back to the reference position with each reset movement. In order thus to give more time, to the selection movement, the reset movement will be performed faster.

In any case the time, which is available for the selection movement, is dependent on the time that is necessary for the reset movement. The coupling of the stationary pile yarn loader to a forward moving cutter however causes a jolt, which with fast running machines leads to the development of vibrations in the pile yarn loaders. The reset movement, whereby all pile yarn loaders have to be brought into a reference position quickly, also causes a strong impact in the weaving machine, which gives a jerk to all accompanying pile yarns. The weaving speed is limited because of this.

SUMMARY OF THE INVENTION

In order to remedy this and in order to increase the operating speed of the jacquard device, puts forward a method of the type described in the the method according to the invention is characterized in that each pile yarn loader is brought directly from a selection position to a following selection position and in that the selection movement remains limited to moving over that distance between two successive selection positions.

According to a distinctive feature of the invention, the choice of the selection movement between two successive selection positions takes into account the pattern to be woven. According to a particular embodiment of the invention the selection movement can occur in both directions.

In an advantageous embodiment the shifting of the pile yarn loaders in order to take up a selection position, occurs by means of a linear motor with electronic control according to the pattern to be woven.

BRIEF DESCRIPTION OF THE DRAWINGS

These characteristics and other characteristics and details of the invention will appear from the following description, which by way of nonrestrictive example shows two different embodiments of the invention.

In these drawings.

In these drawings similar reference symbols refer to the same or similar elements.

DETAILED DESCRIPTION OF THE DRAWINGS

Figure 1:
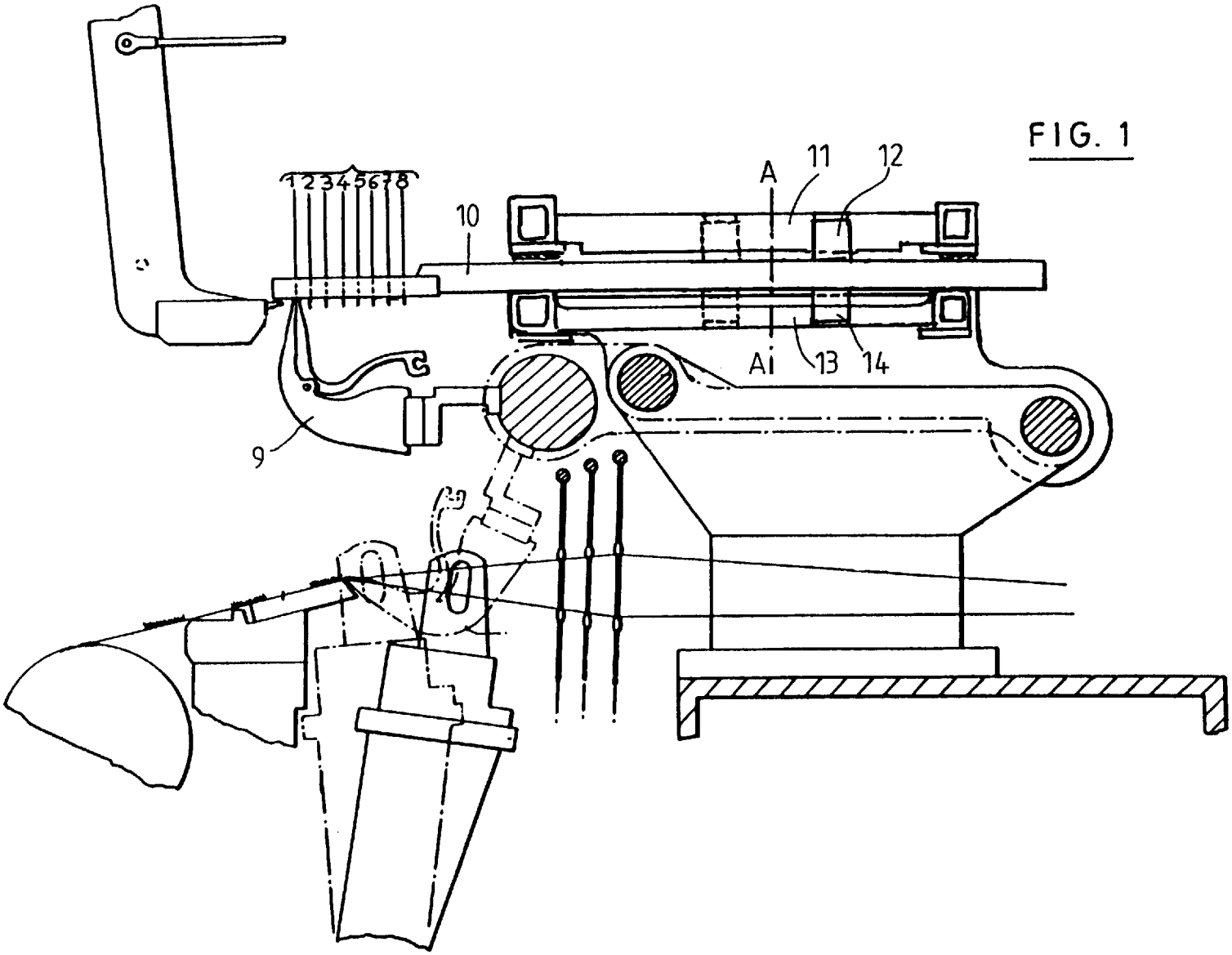
FIG. 1, represents a side view of a device according to the invention.

As shown in FIG. 1, which represents a side view of the device is according to the invention, a carpet weaving machine of the "gripper Axminster" type comprises a series of pile yarn loaders that are movably disposed next to each other. In each loader pile yarns 1–8 of different colors are placed next to each other in a line. The pile yarn loaders 10 are moved under control of an electronic jacquard device by shifting in a linear or longitudinal direction, in order to bring the selected color opposite the gripper jaws.

Each pile yarn loader is connected to a linear motor 11, 13. With a density of e.g. 276 grippers per m. only a division of 3.6 mm per pile yarn is available. The linear motors 11, 13 are therefore preferably placed above and under the pile yarn loaders 10 whereby the odd pile yarn loaders 10 are operated by the above lying 11 and the even pile yarn loaders by the underlying 13 linear motors. Because of this a theoretical division of the linear motors is already obtained that is double the division of the pile yarn loaders.

Each linear motor 11, 13 comprises a stator, provided with windings, and slides or carriers providers slide 12, 14 with permanent poles magnet 21, 22 and 23, 24 respectively.

Figure 2:
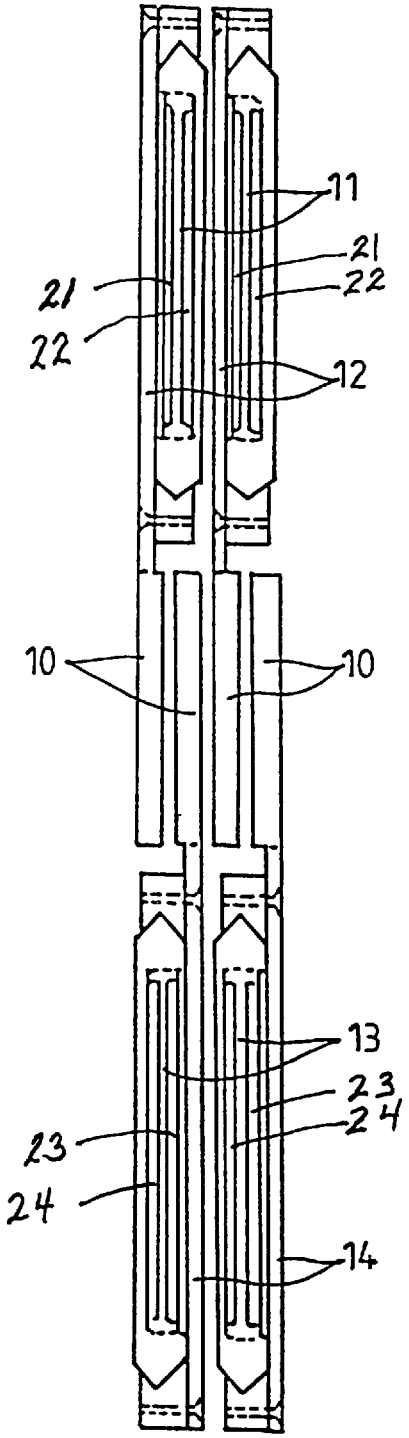
FIG. 2, represents a cross-section on larger scale according to line 1-1' of the device shown in FIG. 1.

In a preferred embodiment the linear motors are used with integrated straight line guides as illustrated in detail in FIG. 2. These straight line guides can be of the slide bearing or the recirculating ball bushing type. If color 5 has to be sent toward the actual color 1, then the pile yarn loader will have to be shifted over (5–1) × mutual distance colors over a positively directed distance, e.g. to the left in FIG. 1. If subsequently color 3 has to be selected, then the pile yarn loader 10 will shift a negative distance over (3–5) × mutual color distance. For this purpose the control of each linear motor 11, 13 will determine the number of movement steps that corresponds to the directed distance between the new and present color. This movement can be performed jolt-free and harmoniously, so that a higher operating speed becomes possible. The individually controllable driving of the pile yarn loaders 10 furthermore makes it possible without external accessories to slide out each pile yarn loader separately for rethreading or for pulling through a snagged pile yarn again. With a weaving machine, equipped with a detection system for a missed pile yarn end, the pile yarn loader can immediately be completely slid out when the machine is at rest so that the loader, on which the fault occurs, is immediately visible and is brought into its most suitable position for servicing or repair of the fault. This device can be utilized for horizontally, obliquely and vertically disposed pile yarn loaders 10.

This driving of the pile yarn loaders 10 is compact and requires no further mechanical driving component. Furthermore use can be made of modern operating techniques, in particular an electronic control directly connected to the electronic control of a jacquard device.

What is claimed is:

1. In a method for positioning pile yarns in variable selection positions in a carpet weaving machine of the gripper Axminster type, and comprising the steps of placing pile yarns (1–8) of different colors next to each other in a line in pile yarn loaders (10), and moving the pile yarn loaders (10) in a selection movement in a longitudinal direction according to a carpet pattern, in order to bring the selected color opposite the gripper jaws (9), said movement being controlled by an electronic jacquard device, the improvement wherein said method further comprises the step of bringing each pile yarn loader (10) directly from a selection position to a following selection position, so that the selection movement remains limited to the distance between two successive selection positions.

2. Method according to claim 1, further comprising performing the selection movement of the pile yarn loaders (10) by shifting each pile yarn loader according to the pattern to be woven, by means of a corresponding electronically controlled linear motor (11, 13).

3. Device for positioning pile yarns in variable selection positions in a carpet weaving machine of the gripper Axminster type, in which pile yarns (1–8) of different colors are disposed in a line next to each other in pile yarn loaders (10), which device comprises successive linear motors (11, 13) for bringing each pile yarn loader (10) in a selection movement directly from a selection position to a following selection position, so that the selection movement remains limited to the distance between two successive selection positions.

4. Device according to claim 3, wherein each pile yarn loader is connected to a corresponding linear motor (11, 13).

5. Device according to claim 3, wherein the successive linear motors are alternately placed above and below the pile yarn loaders (10).

* * * * *